US005586536A

United States Patent [19]

Seo et al.

[11] Patent Number: 5,586,536

[45] Date of Patent: Dec. 24, 1996

[54] APPARATUS FOR AND METHOD OF CONTROLLING ENGINE RPM IN HYDRAULIC CONSTRUCTION EQUIPMENT

[75] Inventors: Jeong Y. Seo; Myung H. Song, both of Changwon, Rep. of Korea

[73] Assignee: Samsung Heavy Industries Co., Ltd., Seoul, Rep. of Korea

[21] Appl. No.: 564,758

[22] Filed: Nov. 29, 1995

[51] Int. Cl.[6] ..... F02D 29/04

[52] U.S. Cl. ..... 123/352; 123/357

[58] Field of Search ..... 123/352–355, 123/357; 414/699

[56] References Cited

U.S. PATENT DOCUMENTS

| | | | |
|---|---|---|---|
| 4,779,591 | 10/1988 | Tordenmalm | 123/352 |
| 4,955,344 | 9/1990 | Tatsumi et al. | 123/352 |
| 4,989,567 | 2/1991 | Fujioka | 123/357 X |

*Primary Examiner*—Tony M. Argenbright

*Attorney, Agent, or Firm*—Kenyon & Kenyon

[57] ABSTRACT

An apparatus for and a method of controlling the engine RPM in hydraulic construction equipment, being capable of detecting a neutral valve position corresponding to the idle state of the construction equipment and controlling the engine to drive at a low RPM while the construction equipment is in its idle state, thereby achieving a reduced noise generation and reduced fuel consumption. The apparatus includes an engine RPM detecting unit for detecting the RPM of the engine, an engine RPM control unit for controlling the engine RPM, a pressure detecting unit for detecting the pressure in a fluid line connected between a hydraulic pump driven by the engine and main valves for actuating actuators, and a control unit for determining whether every main valve is in its neutral position, through a functional computation for a pressure value detected by the pressure detecting unit with a predetermined reference value, and controlling the engine RPM controlling unit to decrease the engine RPM when every main valve is determined as being in its neutral position.

11 Claims, 2 Drawing Sheets

APPARATUS FOR AND METHOD OF CONTROLLING ENGINE RPM IN HYDRAULIC CONSTRUCTION EQUIPMENT

BACKGROUND OF THE INVENTION

1. Field of the Invention

The present invention relates to an apparatus for and a method of controlling the engine RPM (Revolutions Per Minute) in hydraulic construction equipment, and more particularly to such control apparatus and method being capable of detecting a neutral valve position corresponding to the idle state of the construction equipment and controlling the engine to drive at a low RPM while the construction equipment is in its idle state, thereby achieving a reduced noise generation and reduced fuel consumption.

2. Description of the Prior Art

Generally, numerous hydraulic construction equipment employ a device for automatically decreasing the engine RPM (namely, carrying out auto-deceleration) when the hydraulic construction equipment is not performing any operations such as operating a working member thereof, travelling or swinging.

A technique concerned with such auto-deceleration is disclosed in the Japanese Patent Publication No. 85-38561 filed on Sep. 2, 1985. In accordance with this technique, neutral positions of control levers for controlling the operations of working members, travelling or swinging are detected. When a certain period of time elapses after the detection of the neutral position of each control lever, the engine RPM is automatically decreased so that the engine can be driven at a low speed.

However, this system requires the use of a plurality of detection means for detecting respective neutral positions of the control levers. It also requires the use of a time measuring means (timer) so that the engine RPM can be decreased after a certain time has elapsed. As a result, this system has the disadvantage that a number of elements should be used. Furthermore, a series of operations for decreasing the engine RPM and then increasing the decreased engine RPM again are detected, based on specified positions of each control lever, respectively. However, such a detection method results in frequent malfunction. As a result, it is impossible to obtain flexibility in control. In other words, although the transition of the valve state (namely, the position of the valve spool) from the actuating state to the neutral state and vice versa should be accurately detected in terms of the point of time, it may not coincide with the corresponding shift of the control lever due to the tolerance of the valve block given upon machining the valve block.

Where the neutral valve state is determined, based on only the detection for the specified position of each control lever, therefore, malfunctions may occur frequently. Consequently, the conventional system has the disadvantage that auto-deceleration is carried out at a point of time when the auto-deceleration is unnecessary and another disadvantage that the recovery of the engine RPM for re-actuating the working members is delayed.

SUMMARY OF THE INVENTION

Therefore, an object of the invention is to solve the above-mentioned problems involved in the prior art and to provide an apparatus for and a method of controlling the engine RPM in hydraulic construction equipment, being capable of achieving a more accurate auto-deceleration, thereby obtaining a smooth operation, a reduced noise generation and reduced fuel consumption.

In accordance with one aspect, the present invention provides an engine RPM control apparatus for hydraulic construction equipment including an engine, at least one hydraulic pump driven by the engine, at least one actuator driven by the hydraulic pump, at least one main valve adapted to determine the amount and direction of a fluid supplied to the actuator, and a fluid line adapted to connect, in series, the fluid pump to the main valve or to at least one assistant valve manipulated in sync with the main valve, the apparatus comprising: means for detecting an RPM of the engine; means for controlling the engine RPM; means for detecting a pressure in the fluid line; and control means for determining whether the main valve is in its neutral position, through a functional computation for a pressure value detected by the pressure detecting means with a predetermined reference value, and controlling the engine RPM controlling means to decrease the engine RPM when the main valve is determined as being in its neutral position.

The control means comprises storing means for storing a reference working RPM, operating means for comparing an engine RPM, decreased by the engine RPM controlling means and detected by the engine RPM detecting means, with the reference working RPM, and accumulating an error between the compared values, and instructing means for instructing the engine RPM control means to rapidly decrease the engine RPM to an RPM corresponding to the idle state of the engine when the error accumulated by the operating means is more than a predetermined reference value.

In accordance with another aspect, the present invention provides an engine RPM control method for hydraulic construction equipment including an engine, at least one hydraulic pump driven by the engine, at least one actuator driven by the hydraulic pump, at least one main valve adapted to determine the amount and direction of fluid supplied to the actuator, a fluid line adapted to connect, in series, the fluid pump to the main valve, means for detecting an RPM of the engine, means for detecting a pressure in the fluid line, and means for controlling the engine RPM, the method comprising the steps of determining, based on the pressure detected by the pressure detecting means, whether the main valve is in its neutral position, comparing the engine RPM detected by the engine RPM detecting means with a predetermined reference working RPM when the main valve is in its neutral position, accumulating an error between the compared values, and decreasing the engine RPM to an engine RPM of the idle state when the accumulated error is more than a predetermined reference value.

The engine RPM control method comprises the steps of: (a) determining whether the main valve is in its neutral position is executed through a functional computation for the pressure detected by the pressure detecting means with a predetermined reference value; (b) slightly decreasing the engine RPM through the engine RPM control means when the main valve is determined at step (a) as being in its neutral position; (c) detecting the engine RPM decreased at step (b) through the engine RPM detecting means; (d) comparing the engine RPM detected at step (c) with the reference working RPM, and calculating an error between the compared values and accumulating the calculated error; and (e) comparing the accumulated error obtained at step (d) with the predetermined reference value, and decreasing the engine RPM to that of the idle state through the engine RPM controlling means when the accumulated error is more than the predetermined reference value.

BRIEF DESCRIPTION OF THE DRAWINGS

Other objects and aspects of the invention will become apparent from the following description of embodiments with reference to the accompanying drawings in which.

DETAILED DESCRIPTION OF THE PREFERRED EMBODIMENTS

Figure 1:
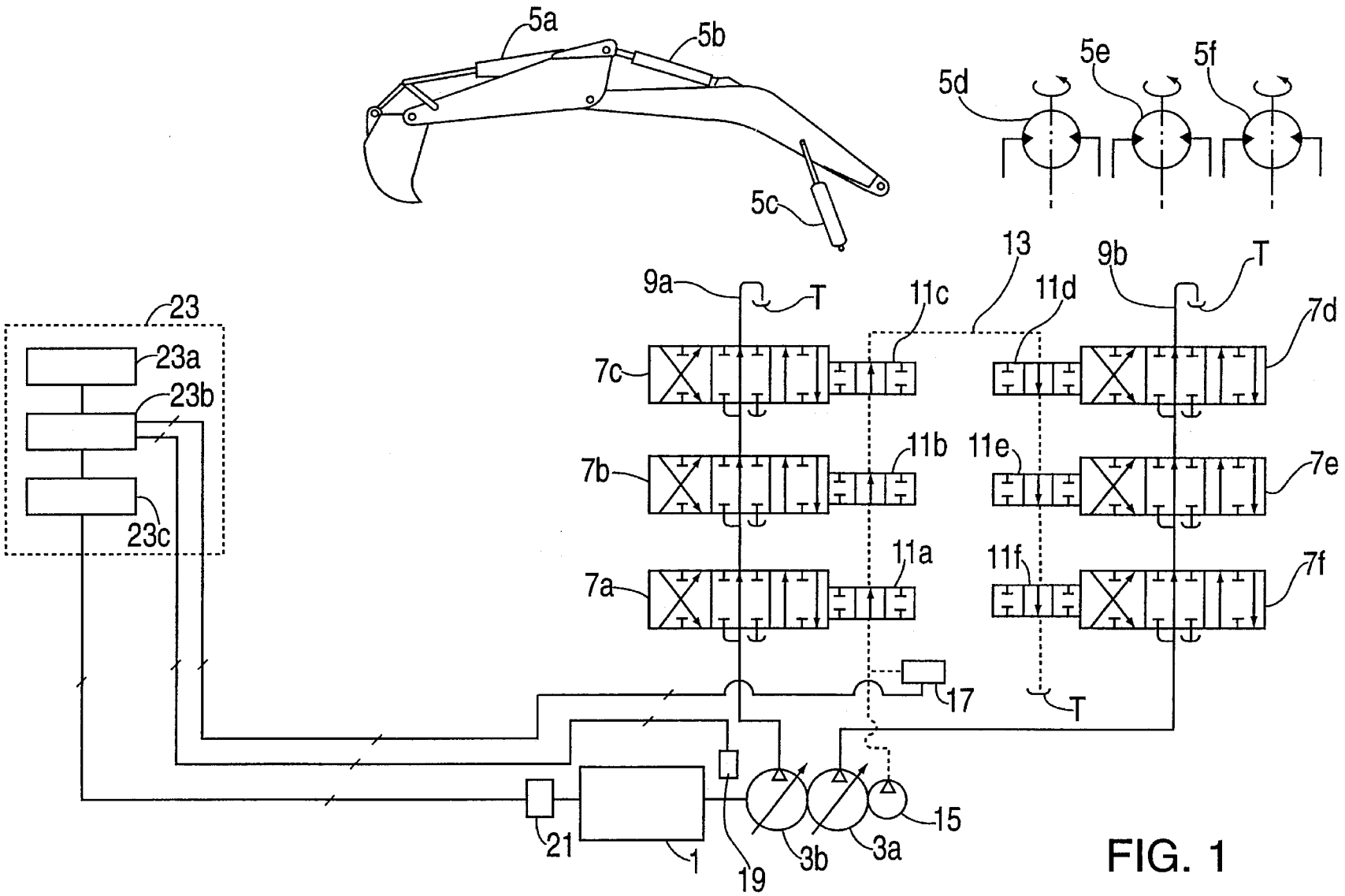
FIG. 1 is a diagram of one type of a hydraulic construction equipment to which an engine RPM control apparatus according to an embodiment of the present invention is applied.

FIG. 1 is a diagram of one type of a hydraulic construction equipment to which an engine RPM control apparatus according to an embodiment of the present invention is applied.

Referring to FIG. 1, an engine 1 is shown which serves to drive a pair of hydraulic pumps 3*a* and 3*b* for driving a plurality of actuators (hydraulic cylinders and hydraulic motors) 5*a*, 5*b*, 5*c*, 5*d*, 5*e* and 5*f*. A plurality of valves are connected to each of the hydraulic pumps 3*a* and 3*b* to determine the amount and direction of fluid supplied to respective actuators. In the illustrated case, valves 7*a*, 7*b* and 7*c* respectively associated with actuators 5*a*, 5*b* and 5*c* are connected to the hydraulic pump 3*b* whereas valves 7*d*, 7*e* and 7*f* respectively associated with actuators 5*d*, 5*e* and 5*f* are connected to the hydraulic pump 3*a*. Each valve has an inner fluid passage which is switched between a position where it is connected to one port of the associated actuator to supply fluid to the actuator and a position where it is connected to the other port of the actuator to drain fluid from the actuator to a tank T. The switching of the inner fluid passage is carried out by shifting a spool included in the valve. When the spool of each valve is in its neutral position, the fluid discharged from the associated hydraulic pump 3*a* or 3*b* is directly returned to the tank T via a bypass fluid line 9*a* or 9*b*.

Assistant valves 11*a*, 11*b*, 11*c*, 11*d*, 11*e* and 11*f* are operatively connected to the main valves 7*a*, 7*b*, 7*c*, 7*d*, 7*e* and 7*f*, respectively. Each assistant valve has an inner fluid passage which is switched between a closed position and an opened position. For each assistant valve, the switching of its inner fluid passage is carried out in sync with the shift of the spool included in the associated main valve. All the assistant valves 11*a*, 11*b*, 11*c*, 11*d*, 11*e* and 11*f* are connected in series with one another via a fluid line 13. The fluid line 13 is connected at one end thereof to a pilot pump 15 which is driven by the engine 1. The fluid line 13 is also connected at the other end thereof to the tank T. The inner fluid passage of each assistant valve is in its opened state when the spool of the main valve associated with the assistant valve is in its neutral state. In this state, the fluid line 13 has a pressure level of 0. In this case, the fluid discharged out of the pilot pump 15 is returned to the tank T via the fluid line 13 without being subjected to any resistance. On the other hand, when at least one of the main valves 7*a*, 7*b*, 7*c*, 7*d*, 7*e* and 7*f* is not in its neutral state by a shift of its spool, the inner fluid passage of theassistant valve associated with the manipulated main valve is closed, thereby increasing the pressure of the fluid line 13. When the manipulated main valve is switched to its neutral position again, the inner fluid passage of the associated assistant valve is opened again. In this case, the pressure of the fluid line 13 is decreased to the level of 0 again.

A pressure detecting unit 17 is installed in the fluid line 13 to detect the above-mentioned pressure variation occurring in the fluid line 13. Although a well-known pressure switch may be used as the pressure detecting unit 17, it is preferred that the pressure detecting unit 17 comprises a pressure sensor capable of detecting a continued pressure variation.

The engine RPM control apparatus also includes an engine RPM detecting unit 19 for detecting the engine RPM, and an engine RPM control unit 21 for detecting the engine RPM. The pressure detecting unit 17, engine RPM detecting unit 19 and engine RPM control unit 21 are all electrically connected to a control unit 23 provided with a microcomputer.

The control unit 23 executes a functional computation for a pressure value detected by the pressure detecting unit 17 with a predetermined reference value, determines whether every main valve is in its neutral position and controls the engine RPM control unit 21 to decrease the RPM of the engine when every main valve is determined as being in its neutral position. The control unit 23 includes a storing unit 23*a* for storing a reference working RPM, an operating unit 23*b* for comparing a decreased engine RPM detected by the engine RPM detecting unit 19 with the reference working RPM, and accumulating the error therebetween, and an instructing unit 23*c* for instructing the engine RPM control unit 21 to rapidly decrease the RPM of the engine 1 to an RPM corresponding to the idle state of the engine 1 when the error accumulated by the operating unit 23*b* is more than a variable, predetermined reference value.

The operation of the engine RPM control apparatus having the above-mentioned arrangement will now be described.

Figure 2:
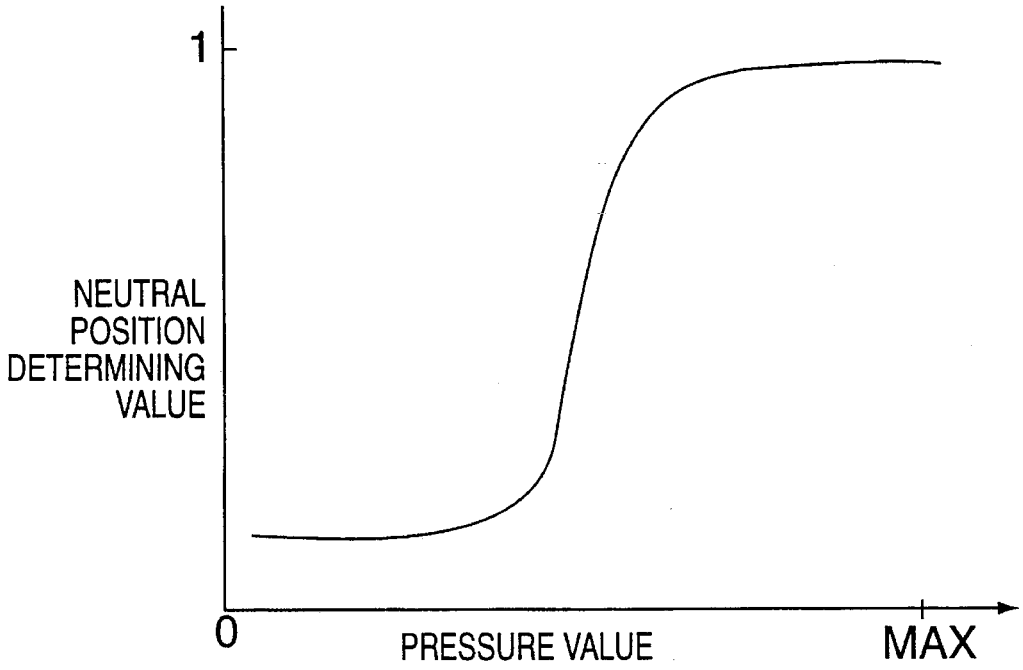
FIG. 2 is a graph depicting the relationship between the pressure detected by a valve's neutral position detecting unit and a reference value for a determination about the valve's neutral position.

The pressure detecting unit 19 detects the pressure of the fluid line 13 and then sends a detect signal indicative of the detected pressure to the control unit 23. Based on the detect signal from the pressure detecting unit 19, the control unit 23 determines whether every main valve is in its neutral position, by using a function with a relationship depicted by an S-shaped graph as shown in FIG. 2. In this case, it is possible to rapidly and accurately detect a variation in the pressure of the fluid line 13, namely, the neutral position of each main valve, as compared to a case wherein such detection is achieved on the basis of only the determination about whether the detected pressure is more than a certain reference pressure.

Once the neutral position of every main valve is detected, the control unit 23 executes a control for decreasing the RPM of the engine in so far as the neutral position of every main valve does not correspond to an intermediate, short pause period between successive operations of the construction equipment. For this control, the control unit 23 applies an instruction signal from its instructing unit 23*c* to the engine RPM control unit 21 to slightly vary (decrease) the RPM of the engine to a level interfering with a subsequent operation of the construction equipment.

Figure 3:
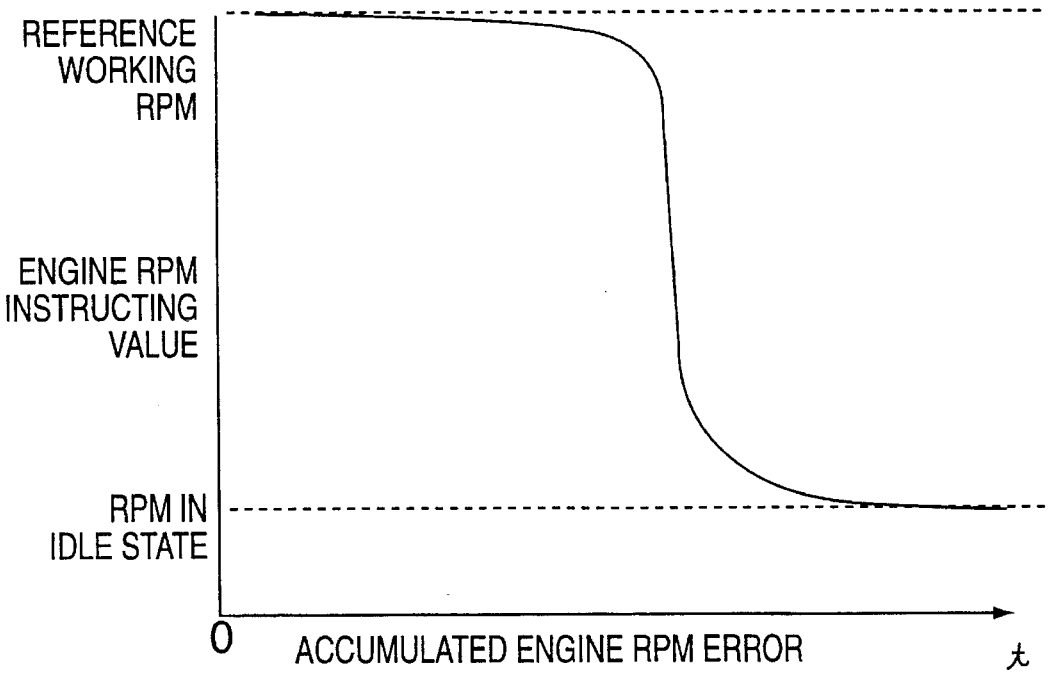
FIG. 3 is a graph depicting the relationship between an accumulated engine RPM error and an engine RPM instructing value.

Thereafter, the engine RPM detecting unit 19 detects the varied engine RPM again. The operating unit 23*b* computes an error between the varied engine RPM and the reference working RPM stored in the storing unit 23*a* and then accumulates the error. Where every main valve is still maintained in its neutral position, it is determined whether the accumulated error is more than the predetermined reference value. This determination is achieved by using a function having a relationship with the accumulated error as shown in FIG. 3. When the accumulated error is more than the predetermined reference value, the control unit 23 applies an instruction signal to the engine RPM control unit 21 via the instructing unit 23*c* so that the engine RPM can be rapidly decreased to an RPM corresponding to the idle state of the engine 1. The predetermined reference value can be variable. When the engine RPM reaches that of the idle state, the error accumulation is stopped to maintain the engine RPM of the idle state. During the execution of the above procedure, the pressure detecting unit 17 continuously detects the pressure of the fluid line 13. When at least one of the main valves is determined, based on the detected pressure, as being manipulated to shift from its neutral position, the control unit 23 applies an instruction signal to the engine RPM control unit 21 via the instructing unit 23*c* so that the engine RPM can be increased to the reference working RPM. The control unit 23 also erases the accumulated error so that the error becomes zero.

Now, an engine RPM control method for hydraulic construction equipment carried out using the above-mentioned engine RPM control apparatus according to the present invention will be described.

In accordance with this method, it is determined at the first step whether every main valves is in its neutral position. This determination is achieved by a functional computation for the pressure of the fluid line 13 detected by the pressure detecting unit 17 with the predetermined reference value.

When every main valve is determined as being in its neutral position, the engine RPM is slightly decreased through the engine RPM control unit 21 at the second step.

At the third step, the engine RPM decreased at the second step is detected through the engine RPM detecting unit 19.

The engine RPM Ncur detected at the third step is compared with the predetermined reference working RPM Nref to calculate an error E therebetween at the fourth step (E–Nref–Ncur).

The error is then accumulated (the resulting accumulated error ΣE is expressed as follows: ΣE–E1+E2+. . . En).

At the fifth step, the accumulated error ΣE obtained at the fourth step is compared with the predetermined reference value Eref.

Where the accumulated error ΣE is determined at the fifth step as being more than the predetermined reference value Eref, the engine RPM is decreased, through the engine RPM control unit 21, to that of the idle state at the sixth step. On the other hand, where the accumulated error ΣE is not more than the predetermined reference value Eref, the procedure is returned to the first step. When every main valve is determined at the first step as being still maintained in its neutral position, the procedure from the second step to the sixth step is repeated. When at least one of the main valves is determined at the first step as being shifted from its neutral position, the engine RPM is increased to the reference working RPM through the engine RPM control unit 21. The accumulated error ΣE is then erased so that it becomes zero.

If the engine RPM is decreased to that of the idle state at the sixth step, the procedure is then returned to the first step. This is executed at the seventh step. When every main valve is determined at the first step as being still maintained in its neutral position, the engine RPM is controlled to keep that of the idle state. On the other hand, when at least one of the main valves is determined as being shifted from its neutral position, the engine RPM is increased to the reference working RPM through the engine RPM control unit 21. The accumulated error ΣE is then erased so that it becomes zero.

As apparent from the above description, the present invention provides an apparatus for and a method for controlling the engine RPM in hydraulic construction equipment, being capable of appropriately decreasing the engine RPM when any actuating valves are not manipulated, thereby achieving a reduced generation of noise and a reduced fuel consumption. In accordance with the present invention, the engine RPM control apparatus has a simple construction over the prior art because a plurality of detecting means for detecting respective neutral positions of control levers included in the conventional construction are substituted by single pressure detecting means. In accordance with the present invention, the determination about the lever's neutral position is more rapidly and accurately achieved because it is not based on a simple determination about whether the detected pressure is more than a certain reference pressure, but based on a continued pressure variation and a certain functional equation. In accordance with the present invention, it is possible to cope with a slight variation in engine RPM depending on the shifted position of the manipulated valve and a slight variation in pressure caused by a tolerance of the valve block by appropriately modifying the functional equation. Accordingly, the present invention provides a more accurate and flexible control for the engine RPM.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. An engine RPM control apparatus for hydraulic construction equipment including an engine, at least one hydraulic pump driven by the engine, at least one actuator driven by the hydraulic pump, at least one main valve adapted to determine the amount and direction of fluid supplied to the actuator, and a fluid line adapted to connect, in series, the fluid pump to the main valve or at least one assistant valve manipulated in sync with the main valve, the apparatus comprising:

means for detecting an RPM of the engine;

means for controlling the engine RPM;

means for detecting a pressure in the fluid line; and control means for determining whether the main valve is in its neutral position, through a functional computation for a pressure value detected by the pressure detecting means with a predetermined reference value, and controlling the engine RPM controlling means to decrease the engine RPM when the main valve is determined as being in its neutral position.

2. The engine RPM control apparatus in accordance with claim 1, wherein the control means comprises:

storing means for storing a reference working RPM;

operating means for comparing an engine RPM, decreased by the engine RPM controlling means and detected by the engine RPM detecting means, with the reference working RPM, and accumulating an error between the compared values; and instructing means for instructing the engine RPM control means to rapidly decrease the engine RPM to an RPM corresponding to the idle state of the engine when the error accumulated by the operating means is more than a predetermined reference value.

3. The engine RPM control apparatus in accordance with claim 2, further comprising means for varying the predetermined reference value.

4. The engine RPM control apparatus in accordance with claim 1, wherein the control means is adapted to erase the accumulated error when the main valve is determined as being shifted from its neutral position through a functional computation for a pressure newly detected by the pressure detecting means after the engine RPM reaches the engine RPM of the idle state, and recovering the engine RPM up to the reference working RPM through the engine RPM control means.

5. The engine RPM control apparatus in accordance with claim 2, wherein the control means is adapted to erase the accumulated error when the main valve is determined as being shifted from its neutral position through a functional computation for a pressure newly detected by the pressure detecting means after the engine RPM reaches the engine RPM of the idle state, and recovering the engine RPM up to the reference working RPM through the engine RPM control means.

6. The engine RPM control apparatus in accordance with claim 3, wherein the control means is adapted to erase the accumulated error when the main valve is determined as being shifted from its neutral position through a functional computation for a pressure newly detected by the pressure detecting means after the engine RPM reaches the engine RPM of the idle state, and recovering the engine RPM up to the reference working RPM through the engine RPM control means.

7. A method for controlling the engine RPM in hydraulic construction equipment including an engine, at least one hydraulic pump driven by the engine, at least one actuator driven by the hydraulic pump, at least one main valve adapted to determine the amount and direction of fluid supplied to the actuator, a fluid line adapted to connect, in series, the fluid pump to the main valve, means for detecting an RPM of the engine, means for detecting a pressure in the fluid line, and means for controlling the engine RPM, the method comprising the steps of determining, based on the pressure detected by the pressure detecting means, whether the main valve is in its neutral position, comparing the engine RPM detected by the engine RPM detecting means with a predetermined reference working RPM when the main valve is in its neutral position, accumulating an error between the compared values, and decreasing the engine RPM to an engine RPM of the idle state when the accumulated error is more than a predetermined reference value.

8. The method in accordance with claim 7, comprising the steps of:

(a) determining whether the main valve is in its neutral position is executed through a functional computation for the pressure detected by the pressure detecting means with a predetermined reference value;

(b) slightly decreasing the engine RPM through the engine RPM control means when the main valve is determined at step (a) as being in its neutral position;

(c) detecting the engine RPM decreased at step (b) through the engine RPM detecting means;

(d) comparing the engine RPM detected at step (c) with the reference working RPM, and calculating an error between the compared values and accumulating the calculated error; and (e) comparing the accumulated error obtained at step (d) with the predetermined reference value, and decreasing the engine RPM to that of the idle state through the engine RPM controlling means when the accumulated error is more than the predetermined reference value.

9. The method in accordance with claim 8, further comprising the steps of:

returning the procedure to step (a) after the engine RPM is decreased to that of the idle state at step (e), keeping the engine RPM of the idle state when the main valve is determined at step (a) as being still maintained in its neutral position while, when the main valve is determined as shifting from its neutral position, recovering the engine RPM up to the reference working RPM through the engine RPM controlling means, and erasing the accumulated error so that the error becomes zero.

10. The method in accordance with claim 8, further comprising the steps of:

returning the procedure to step (a) when the accumulated error is not determined at step (e) as being more than the predetermined reference value, repeating steps (a) to (d) when the main valve is determined at step (a) as being still maintained in its neutral position while, when the main valve is determined as shifting from its neutral position, recovering the engine RPM up to the reference working RPM through the engine RPM controlling means, and erasing the accumulated error so that the error becomes zero.

11. The method in accordance with claim 9, further comprising the steps of:

returning the procedure to step (a) when the accumulated error is not determined at step (e) as being more than the predetermined reference value, repeating steps (a) to (d) when the main valve is determined at step (a) as being still maintained in its neutral position while, when the main valve is determined as shifting from its neutral position, recovering the engine RPM up to the reference working RPM through the engine RPM controlling means, and erasing the accumulated error so that the error becomes zero.

* * * * *